US007353940B2

(12) United States Patent
Sendo

(10) Patent No.: US 7,353,940 B2
(45) Date of Patent: Apr. 8, 2008

(54) TONGUE LID PACK FOR ROD-SHAPED SMOKING ARTICLES AND A BLANK THEREOF

(75) Inventor: Makoto Sendo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 293 days.

(21) Appl. No.: 11/171,446

(22) Filed: Jul. 1, 2005

(65) Prior Publication Data

US 2005/0241967 A1 Nov. 3, 2005

Related U.S. Application Data

(63) Continuation of application No. PCT/JP03/16845, filed on Dec. 26, 2003.

(30) Foreign Application Priority Data

Jan. 20, 2003 (JP) ..... 2003-011362

(51) Int. Cl.
*B65D 85/10* (2006.01)

(52) U.S. Cl. ..... 206/268; 206/273; 229/160.1

(58) Field of Classification Search ..... 206/268, 206/273; 229/149–151, 160.1
See application file for complete search history.

(56) References Cited

U.S. PATENT DOCUMENTS

| | | | | | |
|---|---|---|---|---|---|
| 160,239 | A * | 2/1875 | Shelton | 229/149 |
| 329,134 | A * | 10/1885 | Brotz | 229/149 |
| 1,822,512 | A * | 9/1931 | Tanner | 229/149 |
| 3,861,583 | A * | 1/1975 | Tingley et al. | 229/223 |
| 4,949,841 | A * | 8/1990 | Focke et al. | 206/254 |
| 5,042,653 | A | 8/1991 | Ems | |
| 5,123,589 | A | 6/1992 | Cote | |
| 5,462,223 | A | 10/1995 | Focke et al. | |
| 5,553,773 | A | 9/1996 | Focke et al. | |
| 6,199,687 | B1 * | 3/2001 | Tambo et al. | 206/268 |
| 6,360,943 | B1 | 3/2002 | Focke et al. | |

FOREIGN PATENT DOCUMENTS

| | | |
|---|---|---|
| DE | 40 32 870 A1 | 4/1992 |
| EP | 0 895 940 A2 | 2/1999 |
| JP | 7-251888 A | 10/1995 |
| JP | 7-300169 A | 11/1995 |
| JP | 11-49134 A | 2/1999 |
| WO | WO-96/25333 A | 8/1996 |

* cited by examiner

*Primary Examiner*—Bryon P Gehman
(74) *Attorney, Agent, or Firm*—Birch, Stewart, Kolasch & Birch, LLP

(57) ABSTRACT

A tongue lid pack for filter cigarettes includes a box (2), contents (6) contained in the box (2) and having a cigarette bundle (CB) wrapped in a wrapper (8), a tongue lid (16) for opening and closing an opening end of the box (2), and guard lugs (30) bonded to their respective side walls of the box (2). The guard lugs (30) are connected to the corresponding side edges of the tongue lid (16) through cutting lines (28) when the tongue lid (16) is in its state before being opened for the first time.

14 Claims, 9 Drawing Sheets

TONGUE LID PACK FOR ROD-SHAPED SMOKING ARTICLES AND A BLANK THEREOF

This application is a Continuation of copending PCT International Application No. PCT/JP2003/016845 filed on Dec. 26, 2003, which designated the United States, and on which priority is claimed under 35 U.S.C. § 120. This application also claims priority under 35U.S.C. § 119(a) on Patent Application No(s). 2003-011362 filed in Japan on Jan. 20, 2003. The entire contents of each of the above documents is hereby incorporated by reference.

TECHNICAL FIELD

The present invention relates to a tongue lid pack for rod-like smoking articles including cigarettes, filter cigarettes, and the like, and a blank thereof.

BACKGROUND ART

A typical hinge lid pack is disclosed in, for example, Unexamined Japanese Patent Publication No. 11-49134. This pack described in the Publication includes a box having an inner frame and an outer casing, a lid for opening and closing the opening end of the box, and contents contained in the box. The inner frame forms the opening end of the box in cooperation with the outer casing, and the lid is hinge-jointed to the rear edge of the opening end, namely the outer casing. The contents include a bundle of rod-like smoking articles and a wrapper wrapping the bundle therein.

The pack is further wrapped in a transparent film, and the wrapping film has a tear tape.

The above-mentioned wrapping film has closing end faces in the top and bottom of the pack, and the closing end faces are each formed by folding the film and applying heat sealing thereto.

The heat sealing, however, provides a relatively small adhesion force, and the folds of the film in the closing end faces are thus easily unfolded, which causes the anxiety that the closing end face is opened due to tampering. Furthermore, it is relatively easy to return the closing end face to its original condition by refolding the film thereafter.

If the closing end face is once opened as described, the pack is easily opened as well, so that the tampering with the contents in the pack is possible.

On the other hand, the wrapping film of the pack maintains the quality of the rod-like smoking articles for a long period of time. In the case of the pack provided with the wrapping film, however, the packaging form for the rod-like smoking articles is a triple structure including the wrapper, the blank of the pack, and the film. The packaging form of such a triple structure is over packaging in view of the trend for resource saving in recent years.

An object of the present invention is to provide a tongue lid pack for rod-like smoking articles, which has a tamper-proof function and does not require wrapping film, and a blank thereof.

DISCLOSURE OF THE INVENTION

To achieve an object of the present invention, a tongue lid pack of the present invention comprises: a box having a front wall, an opening end, both side walls, a bottom wall and an insertion slit formed in the front wall; contents contained in the box and including a plurality of rod-like smoking articles and a wrapper wrapping the rod-like smoking articles; a tongue lid jointed to a rear edge of the opening end of the box through a self hinge, for opening and closing the opening end, when the tongue lid is in a closed position, the tongue lid including a lid for covering the opening end of the box, and a tongue connected to the lid through a folding line and being able to be superposed upon the front wall of the box so as to cover the insertion slit; and a joint for separably connecting the tongue lid and the box to each other so that after the tongue lid is opened for the first time, the joint leaves a trace indicating that the tongue lid has already been opened.

According to the tongue lid pack, when the pack is opened for the first time, the tongue lid is separated from the box at the joint, and then leaves a trace in the joint, which indicates that the tongue lid has once been opened. Such a trace is effective for preventing the rod-like smoking articles of contents from being tampered with.

The insertion slit of the box is in a state being covered with the tongue lid until the tongue lid is opened for the first time. Therefore, the contents of the box are hardly exposed to the outside air through the insertion slit, which is useful for quality maintenance of the rod-like smoking articles of the contents. This eliminates the use of wrapping film of the pack.

The tongue lid may have an insertion tip located at the distal end of the tongue. When the tongue lid is once opened and then closed again, the insertion tip is inserted into the box through the insertion slit. The insertion of the insertion tip stably holds the tongue lid in its closed position.

Specifically, the joint may include a pair of guard lugs bonded to respective side faces of the box, and cutting lines for separably connecting the guard lugs to corresponding side edges of the tongue when the tongue lid is in the state before being opened for the first time.

In this case, when the tongue lid is opened for the first time, the cutting lines between the tongue and the respective guard lugs are torn. The torn cutting lines remain as traces in the outer surface of the pack, and these traces are useful for the prevention of tampering.

The box may include one of an access opening formed in the front wall thereof and extending from a front edge of the opening end toward the insertion slit, and a to-be-opened area demarcated by a separating line to form the access opening. The wrapper may include a separable area in a portion corresponding to the access opening, the separable area being demarcated by a separating line. In this case, the pack further includes a first glue-applied area for bonding a back surface of the tongue and the separable area of the wrapper through the access opening or the to-be-opened area.

In the case of the above-mentioned pack, when the tongue lid is opened for the first time, the separable area of the wrapper only is separated from the other portion of the wrapper or separated from the other portion of the wrapper while accompanying separation of the to-be-opened area. The rod-like smoking articles of contents are exposed to the outside through the access opening of the box, so that the rod-like smoking articles are easily pulled out of the box.

The separation of the separable area and the to-be-opened area produces separation pieces. Such separation pieces, however, are held in a manner such that the separation pieces are bonded to a back surface of the tongue lid so that the separation pieces never become trash.

In the case that the box is provided with the to-be-opened area, the access opening of the box is formed when the tongue lid is opened for the first time. Therefore, when the pack is produced, there exists no access opening in the front wall of the box until the tongue lid is opened for the first time. As a consequence, such a box can effectively seals the contents in cooperation with the tongue lid, thus eliminating the use of the wrapping film of the pack.

Furthermore, the contents include an upper closing end face located on the opening end side of the box and formed by folding the wrapper. The upper closing end face has a pair of end flaps, an inner flap and an outer flap that forms part of the separatable area, which are superposed upon the end flaps in order. In this case, the pack preferably further includes a second glue-applied area for bonding the outer flap and the back surface of the lid to each other.

Since the separable area of the wrapper is bonded to the tongue lid through the first and second glue-applied areas, the separation of the separable area is further facilitated and assured.

The contents further include a closing side face located on one side wall side of the box and formed by folding the wrapper. The closing side face is formed by superposing both end edges of the wrapper one upon the other. In this case, the pack preferably further includes a third glue-applied area for bonding the closing side face and an inner surface of the box to each other.

The contents include a lower closing end face located on the bottom wall side of the box and formed by folding the wrapper. In this case, the pack preferably further includes a fourth glue-applied area for bonding the lower closing end face and the bottom wall of the box to each other.

The third and fourth glue-applied areas upgrade the sealing performance of the contents and eliminate the use of the wrapping film of the pack.

It is preferable that the insertion slit is formed into the shape of a substantial V that splays toward the opening end side of the box. Such an insertion slit facilitates the insertion of the tongue lid into the box.

The joint may include a to-be-cutout area demarcated in the front wall of the box by a cutting line, and a fifth glue-applied area formed in the tongue lid, for bonding the to-be-cut-out area to the tongue lid when the tongue lid is in the state before being opened for the first time. Alternatively, the joint may include a to-be-cutout area demarcated in the tongue by a cutting line, and a fifth glue-applied area formed in the front wall of the box, for bonding the to-be-cutout area to the front wall when the tongue lid is in the state before being opened for the first time.

The joint may further include a pair of reinforcing members bonded to the back surface of the lid, and cutting lines for allowing the reinforcing members to be separably connected to the respective side walls of the box when the tongue lid is in the state before being opened for the first time.

The cutting lines for the to-be-cutout areas or the reinforcing members are torn when the tongue lid is opened for the first time. As a result, traces indicating that the tongue lid has already been opened are left in the outer surface of the pack.

The blank for forming the pack with guard lugs comprises: a longitudinal axis; a main section having a rear panel, an outer bottom panel, and a front panel which are adjacently arranged through folding lines along the longitudinal axis, the panels forming a rear wall, a bottom wall, and a front wall of the box, respectively; a pair of inner side flaps connected to respective side edges of the rear panel through folding lines; a pair of inner bottom flaps located on respective sides of the outer bottom panel and connected to the respective inner side flaps through folding lines, the inner bottom flaps forming reinforcing members for the bottom wall of the box; a pair of outer side flaps connected to respective side edges of the front panel through folding lines, the outer side flaps forming side walls of the box together with the corresponding inner side flaps; a sub section extending from the main section along the longitudinal axis and connected to the rear panel through a folding line as a self hinge, the sub section having an outer top panel and a tongue panel that are demarcated by a folding line and form the lid and the tongue of the box, respectively; and a pair of lug flaps connected to respective side edges of the tongue panel through cutting lines, the lug flaps forming the guard lugs as first joints when the lug flaps are bonded to the corresponding outer side flaps.

In this case, the blank may include a pair of inner top flaps arranged on respective sides of the outer top panel, the inner top flaps is connected to the corresponding inner side flaps through cutting lines. The inner top flaps are bonded to the lid of the tongue lid when the tongue lid is in the state before being opened for the first time, and form second joints.

BEST MODE OF CARRYING OUT THE INVENTION

Figure 1:
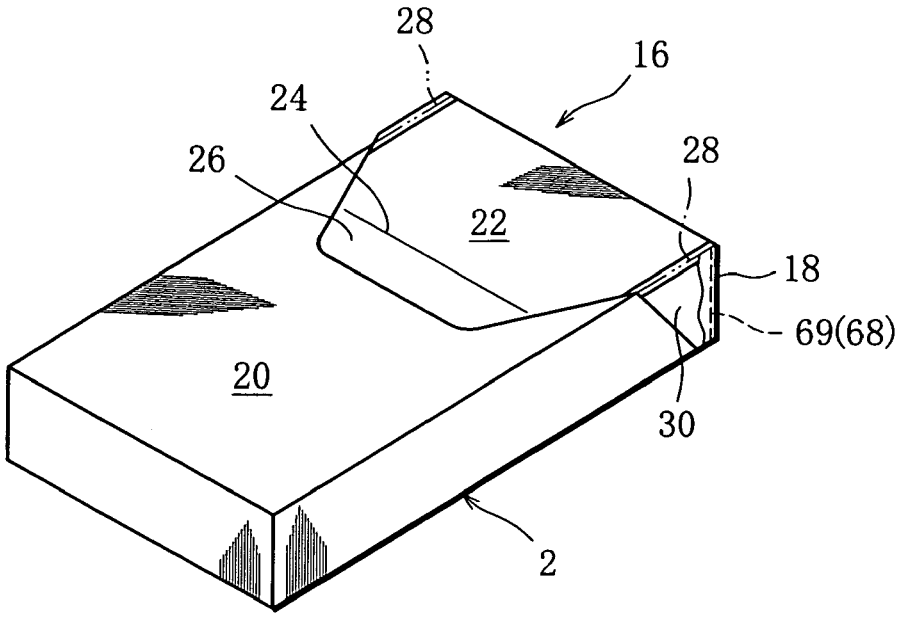
FIG. 1 is a perspective view of a tongue lid pack according to one embodiment.
Figure 2:
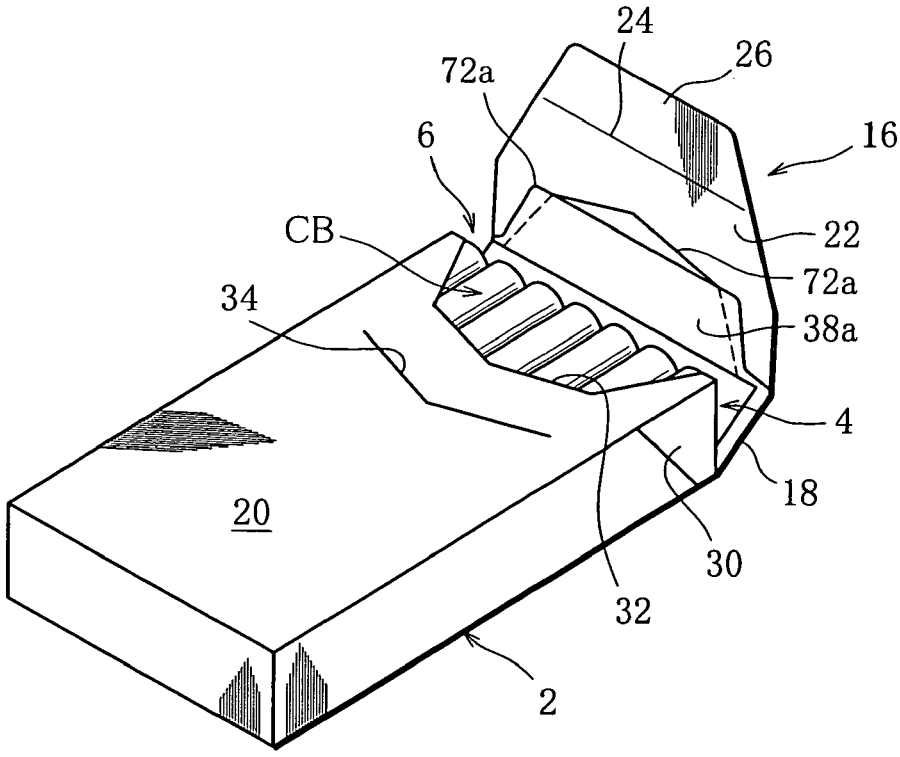
FIG. 2 is a perspective view showing the pack of FIG. 1 in its open state.

FIGS. 1 and 2 show a tongue lid pack for filter cigarettes.

The pack includes a rectangular parallelepiped-shaped box 2, which has an opening end 4. Contained in the box 2 are contents 6, which include a bundle of twenty filter cigarettes CB and a wrapper 8 wrapping the cigarette bundle CB therein. The wrapper 8 has a base layer made of paper or the like and a metal thin film formed on a surface of the base layer. The wrapper 8 is discarded as burnable material just like the box 2 in view of waste separation and disposal.

Specifically, the contents 6 have both end faces of a double-point end fold, namely closing end faces 10, 12 and a side face 14 of a side long seam, as viewed in the folding configuration of the wrapper 8.

A tongue lid 16 is connected to a rear edge of the opening end 4 of the box 2 through a self hinge. The tongue lid 16 allows the opening end 4 to open and close. When the tongue lid 16 is in a closed position, the tongue lid 16 has a lid 18 that covers the opening end 4 and a tongue 22 connected to the lid 18 through a folding line, and the tongue 22 covers part of a front wall 20 of the box 2. The tongue 22 has a distal end portion that is tapered and includes an insertion tip 26 demarcated by a folding line 24.

Both side walls of the box 2 each have a guard lug 30, which is bonded to the corresponding side wall of the box 2. When the tongue lid 16 is not yet opened, the guard lugs 30 are connected to a root portion of the tongue 22 through cutting lines 28 as illustrated in FIG. 1. Once the tongue lid 16 is opened for the first time, however, the tongue 22 is separated from the guard lugs 30 along the cutting lines 28.

When the tongue lid 16 is opened for the first time, an access opening 32 is formed in the front wall 20 of the box 2 as illustrated in FIG. 2. The access opening 32 has the shape of a substantial U and extends from the opening end 4 of the box 2.

In conjunction with the formation of the access opening 32, part of the wrapper 8 of the contents 6 is removed, which partially exposes the cigarette bundle CB of the contents 6 through the access opening 32. As a result, the filter cigarettes in the contents 6 can be easily pulled out through the access opening 32. The part of the wrapper 8, which is to be removed, has the same shape as the access opening 32.

When the tongue lid 16 is opened, an insertion slit 34 is exposed. The insertion slit 34 is beforehand formed in the front wall 20 of the box 2. The tongue 22 of the tongue lid 16 is in a state covering the insertion slit 34 until the tongue lid 16 is opened for the first time.

As is clear from FIG. 2, the insertion slit 34 has the shape of a substantial V that splays toward the access opening 32, thereby being capable of receiving the insertion tip 26 of the tongue 22 without difficulty. Therefore, after the tongue lid 16 is once opened, the insertion tip 26 of the tongue 22 is inserted into the box 2 through the insertion slit 34, and the tongue lid 16 is maintained in the closed position. The shape of the insertion slit 34 is not limited to the letter V, but may be a concave.

Figure 3:
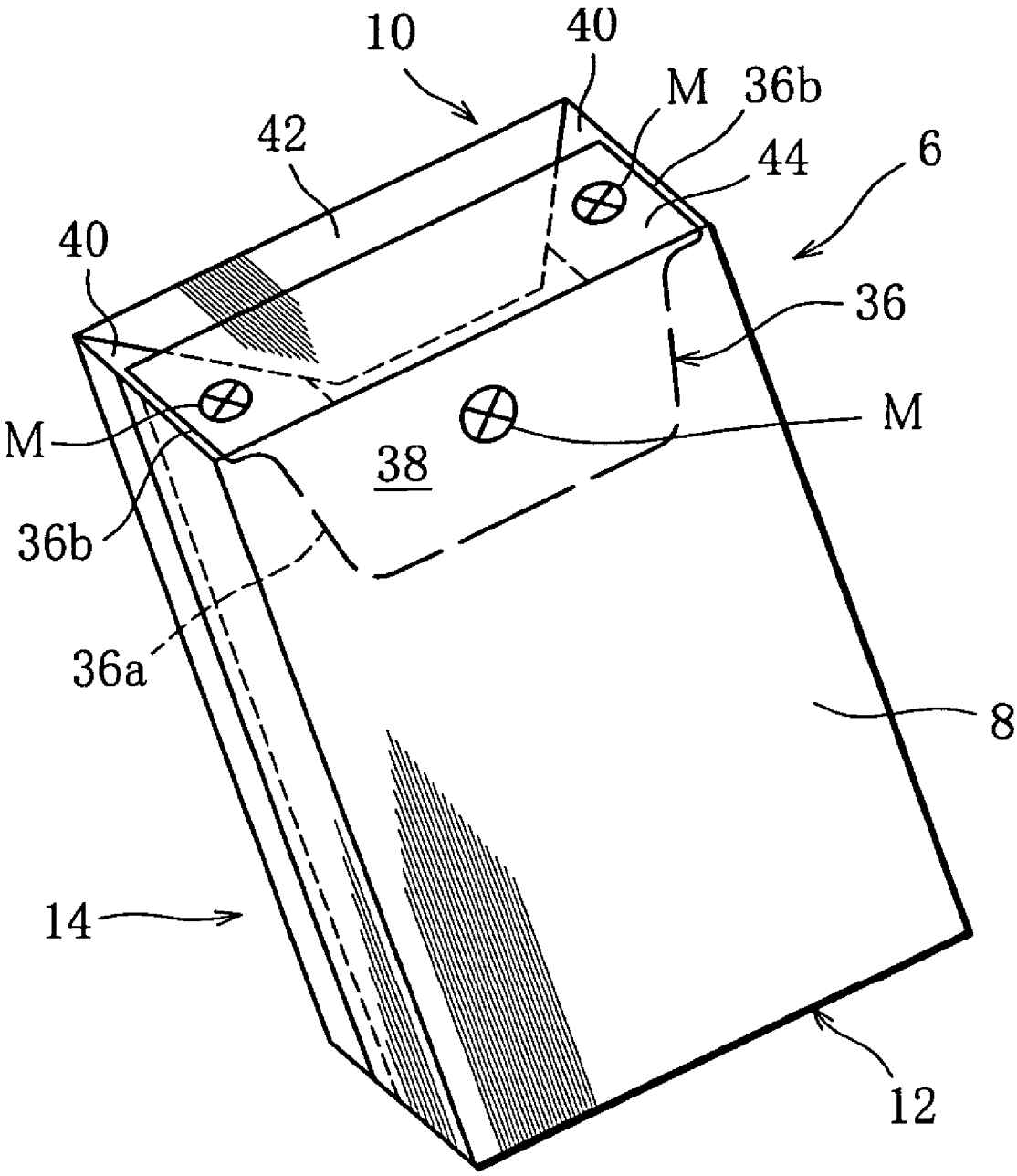
FIG. 3 is a perspective view of contents contained in the pack of FIG. 1.

In order to enable formation of the access opening 32 and removal of the part of the wrapping material 8, a separating line 36 is formed in the wrapper 8 as illustrated in FIG. 3. The separating line 36 includes a substantially U-shaped perforation line 36*a* and slits 36*b* extending from respective ends of the perforation line 36*a*. The perforation line 36*a* is located on the upper closing end face 10 side of the contents 6, and demarcates an area in the wrapper 8 forming a front face of the contents 6. The area has the same shape and size as the access opening 32. The slits 36*b* are located in the upper closing end face 10.

More specifically, as is obvious from FIG. 3, the upper closing end face 10 includes right and left end flaps 40, and also an inner flap 42 and an outer flap 44 superposed upon the end flaps 40 in order. The outer flap 44 is beforehand demarcated from the other portion of the wrapper 8 by the slits 36*b*.

Figure 4:
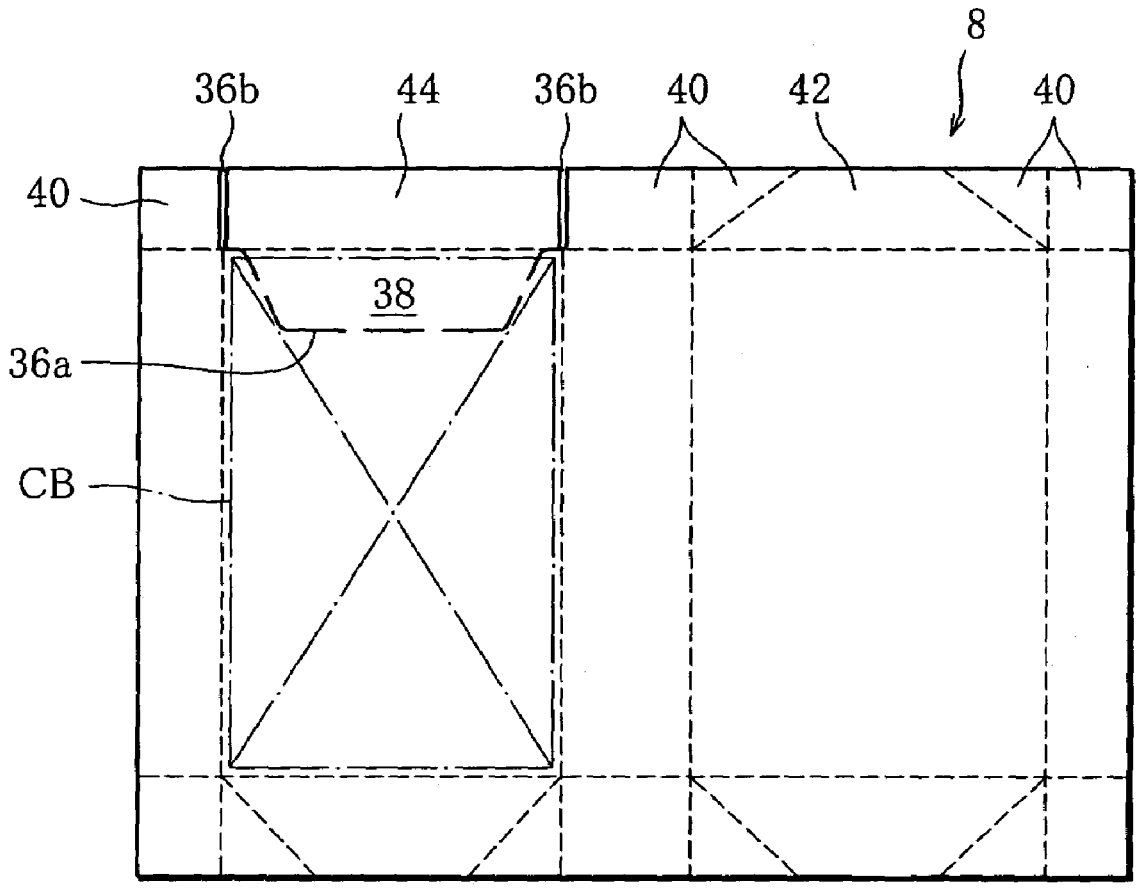
FIG. 4 is a development view of a wrapper of the contents of FIG. 3.

FIG. 4 is a development view of the wrapper 8. As is also apparent from this development view, a portion for forming the outer flap 44 and portions for forming the end flaps 40 are beforehand demarcated from each other by the slits 36*b*.

The separating line 36 marks off a separable area 38 in the wrapper 8, and the separable area 38 includes the area demarcated by the perforation line 36*a* and the outer flap 44. The separating line 36 may be made up of a perforation line in whole. Dashed lines in FIG. 4 indicate folding lines of the wrapper 8. The wrapper 8 is folded around the cigarette bundle CB along the folding lines, to thereby form the contents 6.

Figure 5:
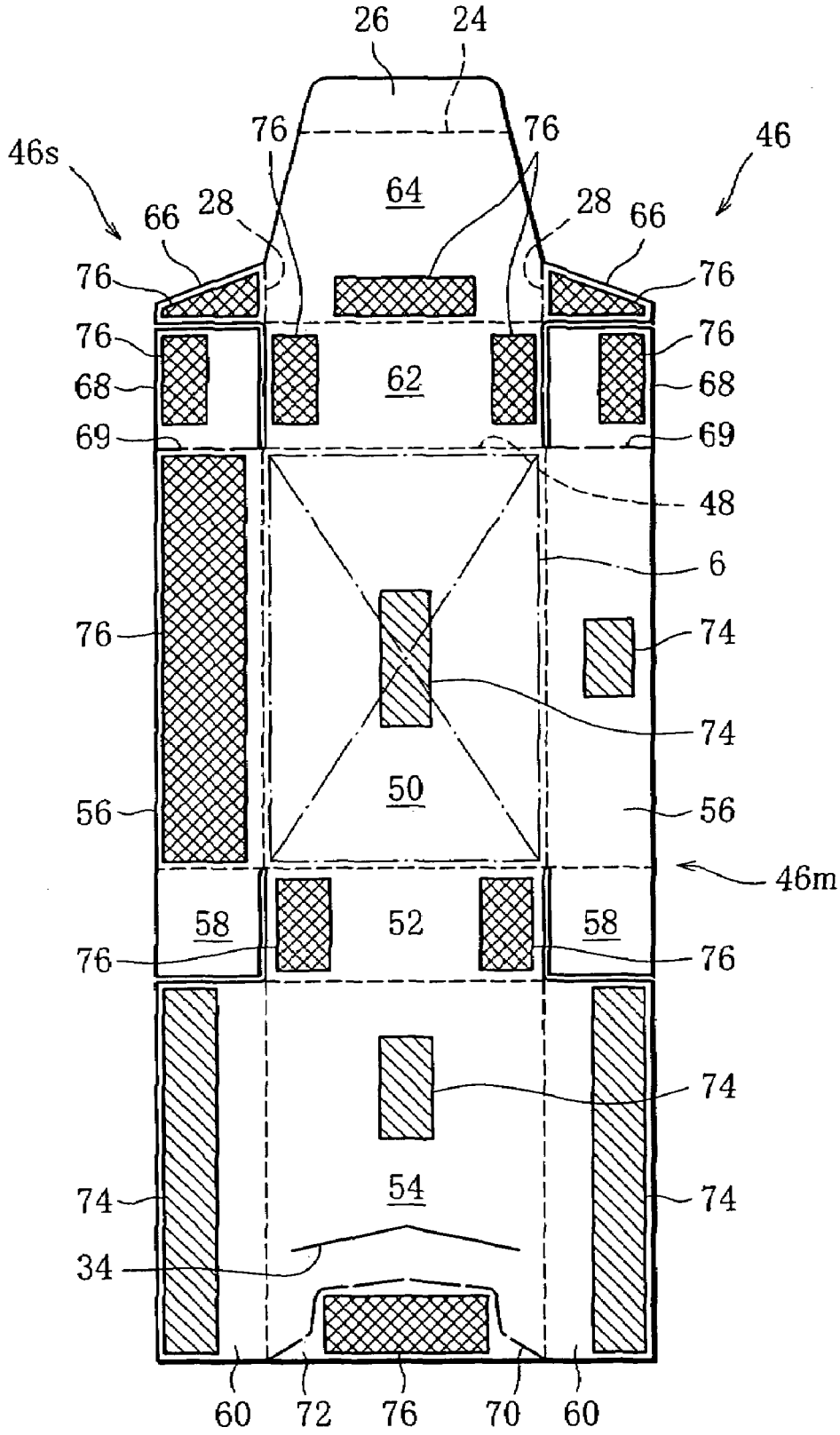
FIG. 5 is a view showing a blank for forming the pack of FIGS. 1 and 2.

FIG. 5 shows a blank 46 for forming the box 2 and the tongue lid 16.

The blank 46 comprises a main section 46*m* for forming the box 2 and a sub section 46*s* for forming the tongue lid 16. The sections 46*m*, 46*s* are connected to each other through a folding line 48 shown by a dashed line, which forms the self hinge, and are adjacent to each other in a longitudinal axis direction of the blank 46.

Other folding lines described below are all shown by dashed lines in FIG. 5.

The main section 46*m* is partitioned by two folding lines into three panels, as viewed in the longitudinal direction of the blank 46. The panels are called a rear panel 50, an outer bottom panel 52, and a front panel 54 in order from the sub section 46*s* side. The panels 50, 52 and 54 are portions for forming the rear wall, the bottom wall and the front wall 20 of the box 2, respectively.

A pair of inner side flaps 56 is connected to respective side edges of the rear panel 50 through folding lines. Inner bottom flaps 58 are connected to respective lower edges of the inner side flaps 56 through folding lines. The inner bottom flaps 58 are located on respective sides of the outer bottom panel 52 and form reinforcing members for the outer bottom panel 52.

A pair of outer side flaps 60 is connected to respective side edges of the front panel 54 through folding lines. The outer side flaps 60 can form the side walls of the box 2 in cooperation with the corresponding inner side flaps 56.

The sub section 46*s* is partitioned by a folding line into two panels, which are called an outer top panel 62 and a tongue panel 64 in order from the rear panel 50 side. The outer top panel 62 is a portion for forming the lid 18 of the tongue lid 16. The tongue panel 64 has the insertion tip 36 and the folding line 24.

Lug flaps 66 are formed in respective side edges of the tongue panel 64 through the cutting lines 28. The lug flaps 66 are portions for forming the guard lugs 32.

A pair of inner top flaps 68 is located on respective sides of the outer top panel 62. The inner top flaps 68 are connected to respective upper edges of the inner side flaps 56 through cutting lines 69. The inner top flaps 68 are portions to be reinforcing members for the lid 18.

Furthermore, the insertion slit 34 and a separating line 70 are beforehand formed in the front panel 54. The separating line 70 marks off a to-be-opened area 72 in a lower portion of the front panel 54. The to-be-opened area 72 is a portion for forming the access opening 32.

The panels and the flaps have respective glue-applied areas 74 in prescribed positions of back surfaces thereof. The glue-applied areas 74 are represented by hatching in FIG. 5. The glue-applied areas 74 are used for bonding between the panels and/or the flaps and the contents 6 and adhesion of the flaps to each other.

Although the glue-applied areas 74 are also provided to the blank for an ordinary pack, the blank 46 of the present invention is newly provided with a plurality of glue-applied areas 76 in addition to the glue-applied areas 74. The glue-applied areas 76 are also formed in the back surface of the blank 46 and represented by cross-hatching in FIG. 5.

Specifically, the glue-applied areas 76 are formed in the to-be-opened area 72, both side edge portions of the outer bottom panel 52, one of the inner side flaps 56 which is corresponding to the side seam side of the contents 6, both side edge portions of the outer top panel 62, the pair of inner top flaps 68 and the pair of lug flaps 66, respectively.

A function of the glue-applied areas 76 will be clarified in the following explanation about a forming process of the pack, which is given with reference to FIGS. 6 through 8.

Figure 6:
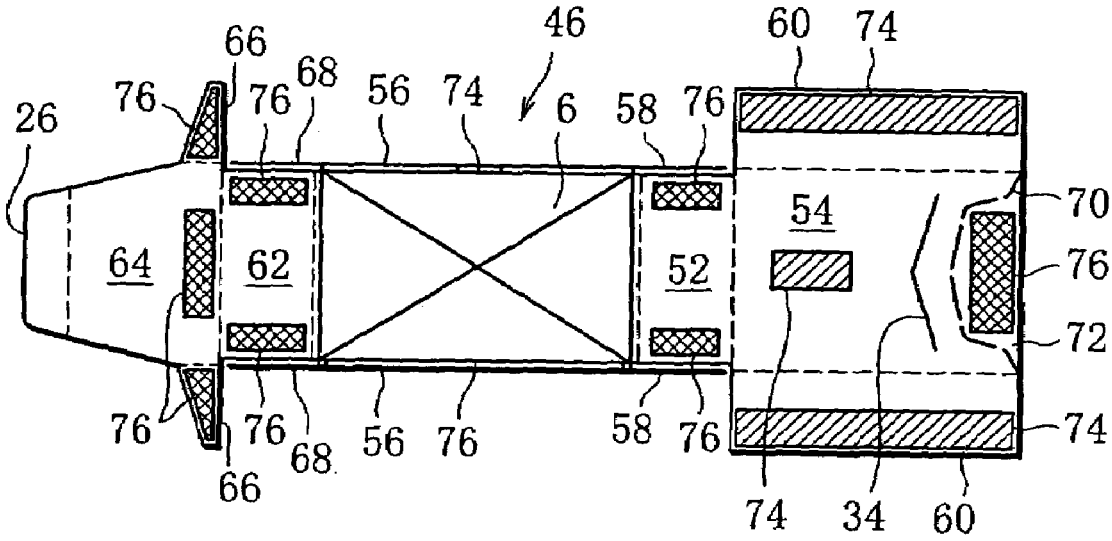
FIGS. 6 through 8 are views showing a folding process of the blank of FIG. 5 in order.

Firstly, the contents 6 are supplied onto the back surface of the blank 46 as illustrated in FIG. 6. The contents 6 are superposed upon the rear panel 50, and the glue-applied area 74 of the rear panel 50 bonds the contents 6 and the rear panel 50 to each other.

Secondly, the pair of inner side flaps 56 are folded toward respective side faces of the contents 6 and superposed upon the respective side faces. The glue-applied area 76 of one inner side flap 56 bonds one side face of the contents 6 and the one inner side flap 56 to each other, and the glue-applied area 74 of the other inner side flap 56 bonds the other side face of the contents 6 and the other inner side flap 56 to each other.

As illustrated in FIG. 6, after the folding of the inner side flaps 56, the inner bottom flaps 58 and the inner top flaps 68 are aligned with the corresponding inner side flaps 56.

Since the one inner side flap 56 is bonded to the closing side face 14 (see FIG. 3) of the contents 6 through the glue-applied area 76 as described, the one inner side flap 56 covers the side seam of the closing side face 14 and upgrades a sealing performance of the side seam.

The side seam of the closing face 14 is obtained by superposing both end edges of the wrapper 8 on the side face of the cigarette bundle CB one upon the other after the wrapper 8 is wound around the cigarette bundle CB to form the letter U.

Figure 7:
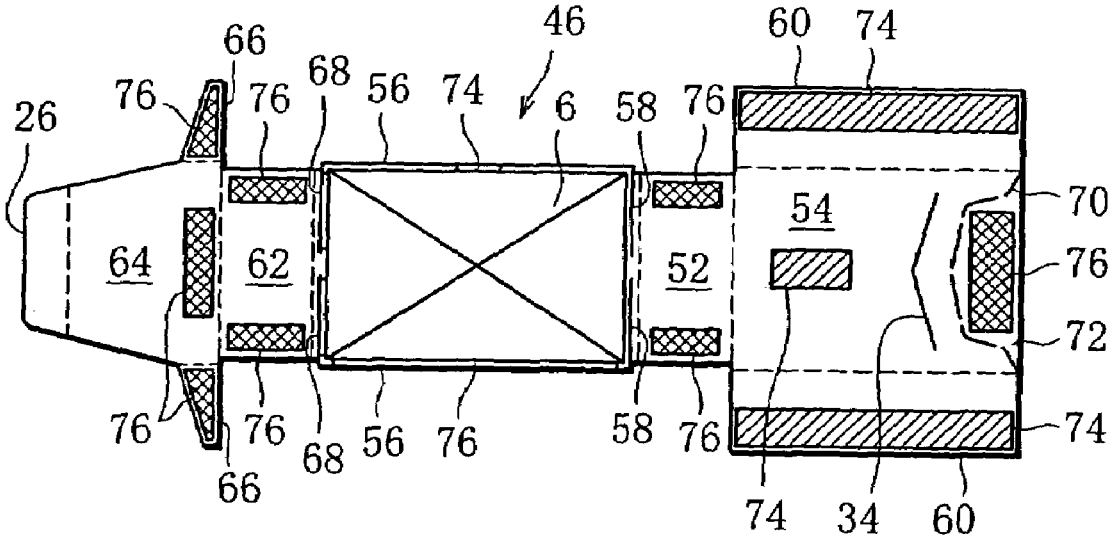

Subsequently, as illustrated in FIG. 7, the pair of inner bottom flaps 58 are folded toward the lower closing face 12 of the contents 6 and superposed upon the lower closing face 12. Simultaneous with the folding of the inner bottom flaps 58, the pair of inner top flaps 68 are folded along the cutting lines 69 (see FIG. 5) toward the upper closing end face 10 (see FIG. 3) of the contents 6 to be superposed upon the upper closing end face 10. The glue-applied areas 76 of the inner top flaps 68 bond the inner top flaps 68 to the outer flap 44 of the upper closing end face 10. Adhering positions of the pair of inner top flaps 68 with respect to the outer flap 44 are denoted by M, in FIG. 3.

Figure 8:
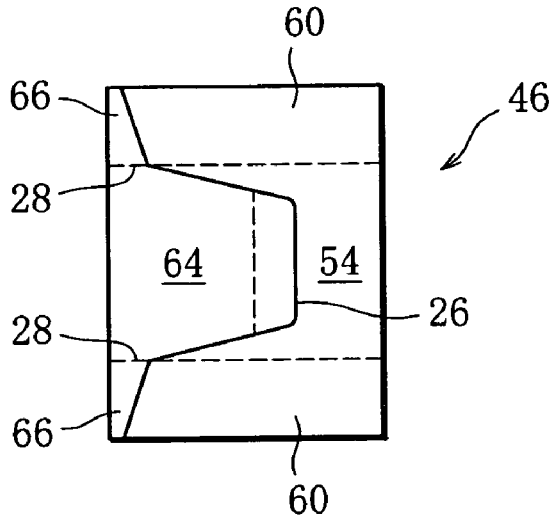

Thereafter, as illustrated in FIG. 8, the outer bottom panel 52 is folded toward the lower closing face 12 of the contents 6 together with the front panel 54 and superposed upon the lower closing face 12 through the inner bottom flaps 58 that have already been folded. The glue-applied areas 76 of the outer bottom panel 52 bond the outer bottom panel 52 to the pair of inner bottom flaps 58. At this time, the bottom wall of the box 2 is formed.

When the pair of inner bottom flaps 58 and the outer bottom panel 52 are bonded together as described, the bottom wall of the box 2 improves a sealing performance of the contents 6.

In the next stage, the front panel 54 is folded toward the upper face of the contents 6 together with the pair of the outer side flaps 60 and superposed upon the upper face of the contents 6. The glue-applied area 74 of the front panel 54 bonds the front panel 54 and the contents 6 to each other. The glue-applied area 76 of the front panel 54 bonds the to-be-opened area 72 and the separable area 38 of the wrapper 8 in the contents 6 to each other. An adhering position of the to-be-opened area 72 and the separable area 72 is also denoted by M, in FIG. 3.

After the folding of the front panel 54 is completed, the outer top panel 62 is folded toward the upper closing face 10 of the contents 6 together with the tongue panel 64, and superposed upon the upper closing face 10 through the pair of inner top flaps 68 that have already been folded. The pair of glue-applied areas 76 of the outer top panel 62 bonds the outer top panel 62 to the inner top flaps 68. At this time, the lid 18 of the tongue lid 16 is formed.

It should be noted that the outer top panel 62 is bonded to the outer flap 44 of the wrapper 8 through the pair of inner top flaps 68, and that the inner top flaps 68 are connected to the corresponding inner side flaps 56 through the cutting lines 69.

Subsequently, as illustrated in FIG. 8, the tongue panel 64 is folded toward the upper face of the contents 6 and superposed upon the front panel 54 that has already been folded, thereby covering the insertion slit 34 of the front panel 54. The glue-applied area 76 of the tongue panel 64 bonds the tongue panel 64 and the to-be-opened area 72 of the front panel 54 to each other. Therefore, the tongue panel 64 is brought into a state bonded to the separable area 38 of the contents 6 through the to-be-opened area 72.

Along with the folding of the tongue panel 64, the pair of lug flaps 66 is superposed upon the outer side flaps 60 of the front panel 54, and the glue-applied areas 76 of the lug flaps 66 bond the lug flaps 66 to the corresponding outer side flaps 60. This is illustrated in FIG. 8.

Thereafter, in the state shown in FIG. 8, the pair of outer side flaps 60 are folded toward the respective side faces of the contents 6 together with the lug flaps 68 and superposed upon the pair of inner side flaps 56 that have already been folded onto the respective side faces of the contents 6. The glue-applied areas 74 of the outer side flaps 60 bond the outer side flaps 60 to the corresponding inner side flaps 76. At this time, both side walls of the box 2 are formed, and the production of the pack of FIG. 1 is completed. During the production of the pack, both the side walls have respective guard lugs 30, which are in a state connected to the tongue lid 16 through the cutting lines 28.

The folding process of the blank 46 is substantially the same as that of the blank for an ordinary pack. Therefore, the pack of the present invention can be produced only by installing a glue-applying device, not shown, for the glue-applied areas 76 into an ordinary packing machine.

When the pack of the present invention is opened for the first time, firstly the tongue 22 of the tongue lid 16 is raised from the front wall 20 of the box 2. Due to the raise of the tongue 22, the to-be-opened area 72 is cut away from the front wall 20 of the box 2, and the access opening 32 is formed in the front wall 20. Since the to-be-opened area 72 is also bonded to part of the separable area 38 of the contents 6 through the glue-applied area 76, the separable area 38 is also separated along the perforation line of the separating line 36.

When the tongue 22 is further raised, tongue 22 is separated from the pair of guard lugs 30 along the cutting lines 28. Subsequently, when the tongue lid 16 is turned around the self hinge, the lid 18 (the pair of inner top flaps 68) is separated (see FIG. 1) from both the side walls (the pair of inner side flaps 56) of the box 2 along the cutting lines 69, and thus released from the box 2.

Since the cutting lines 28, 69 are both exposed outside the box 2, after the tongue 22 and the lid 18 are separated from the guard lugs 30 and the side walls of the box 2, the cutting lines 28, 69 are left in the outer surface of the box 2 as tearing lines. Traces of such tearing lines are effective for prevention of tampering with the contents 6.

As illustrated in FIG. 2, when the tongue lid 16 thoroughly opens the opening end 4 of the box 2, the cigarette bundle CB of the contents 6 is exposed to the outside through the access opening 32 and part of the opening end 4 of the box 2. This allows access to the filter cigarettes contained in the contents 6, so that the filter cigarettes can be easily taken out of the box 2.

The cut-away of the to-be-opened area 72 and the removal of the separable area 38 form separation pieces 72*a*, 38*a* corresponding to the areas 72, 38. However, the separation pieces 72*a*, 38*a* are in a state bonded to each other by the glue-applied area 76, and moreover the separation piece 72*a* is in a state bonded to the back surface of the tongue 32 through the glue-applied area 76. Therefore, the separation pieces 72*a*, 38*a* are held in a manner such that the pieces 72*a*, 38*a* are bonded to the back surface of the tongue 32 as illustrated in FIG. 2.

As a result, the separation pieces 72*a*, 38*a* are not disposed as separate trash from the pack body 2, so that the reduction of waste is achieved.

Since the outer flap 44 of the separable area 38 is bonded to the inner top flaps 68 of the lid 18 through the glue-applied areas 76, the separable area 38 is smoothly removed. The outer flap 44 is bonded to an inner surface (inner top flaps 68) of the lid 18, so that part of the separable area 38 never sticks out from the tongue lid 16.

The present invention is not limited to the above embodiment, but various modifications can be made.

For example, the pair of inner bottom flaps 58 may have glue-applied areas in back surfaces thereof. In this case, the inner bottom flaps 58 are bonded directly to the lower closing end face 14 of the contents 6, to thereby enhance the sealing performance of the lower closing face 14.

The blank 46 does not necessarily require the pair of inner top flaps 68. In this case, the outer top panel 62 is bonded to the outer flap 44 of the wrapper 8 of the contents 6 through the pair of glue-applied areas 76.

Figure 9:
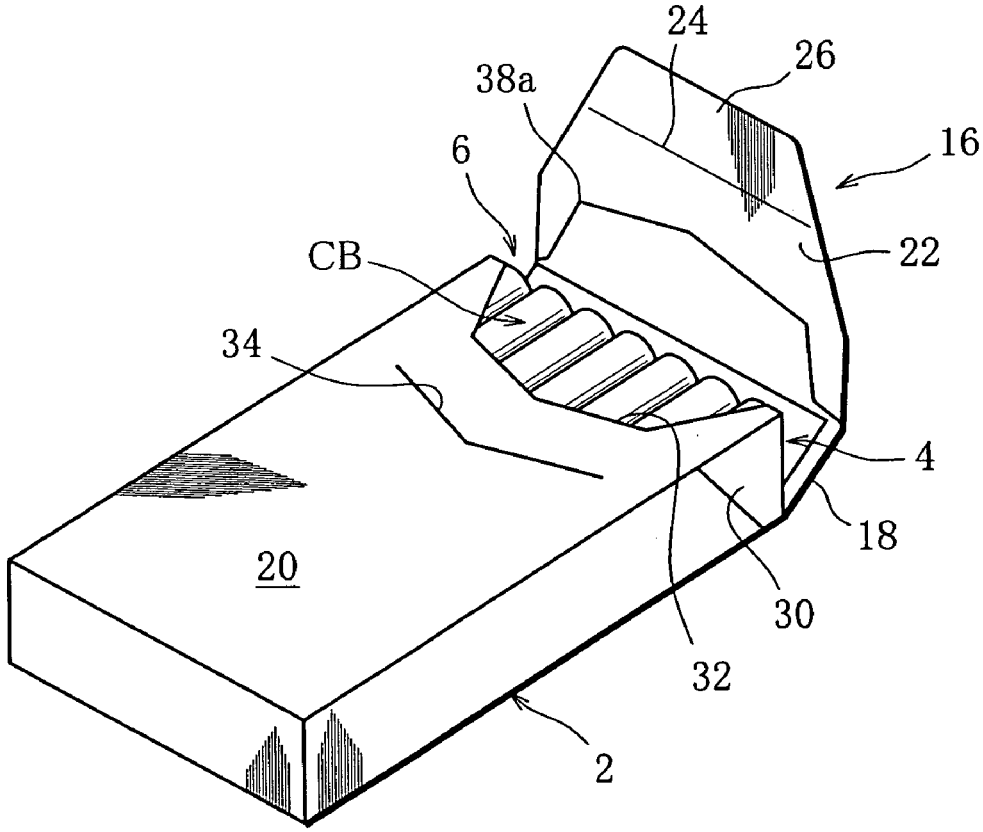
FIG. 9 is a perspective view of a tongue lid pack of a modification example.

In the above-described embodiment, when the tongue lid 16 is opened for the first time, the access opening 32 is formed in the front wall 20 of the box 2. However, the access opening 32 may be beforehand formed in the front panel 54 of the blank 46. In this case, the tongue panel 64 is bonded to the separable area 38 through the glue-applied area 76. Therefore, when the tongue lid 16 is opened for the first time, only the separable area 38 is removed from the wrapping material 8 as illustrated in FIG. 9, to thereby form the separation piece 38*a*. The separation piece 38*a* is held in a state bonded to the back surface of the tongue lid 16.

Figure 10:
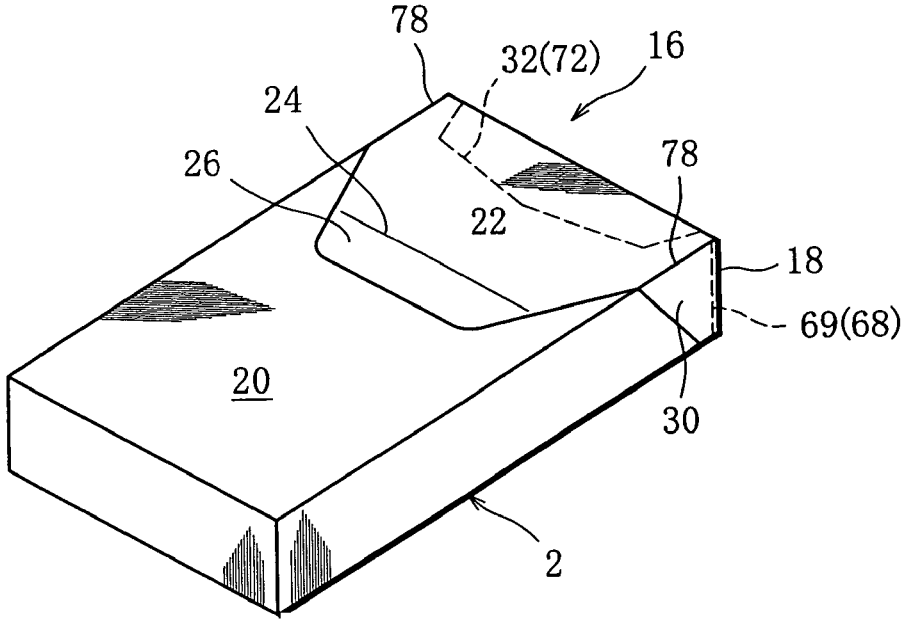
FIG. 10 is a perspective view of a tongue lid pack of a modification example.
Figure 11:
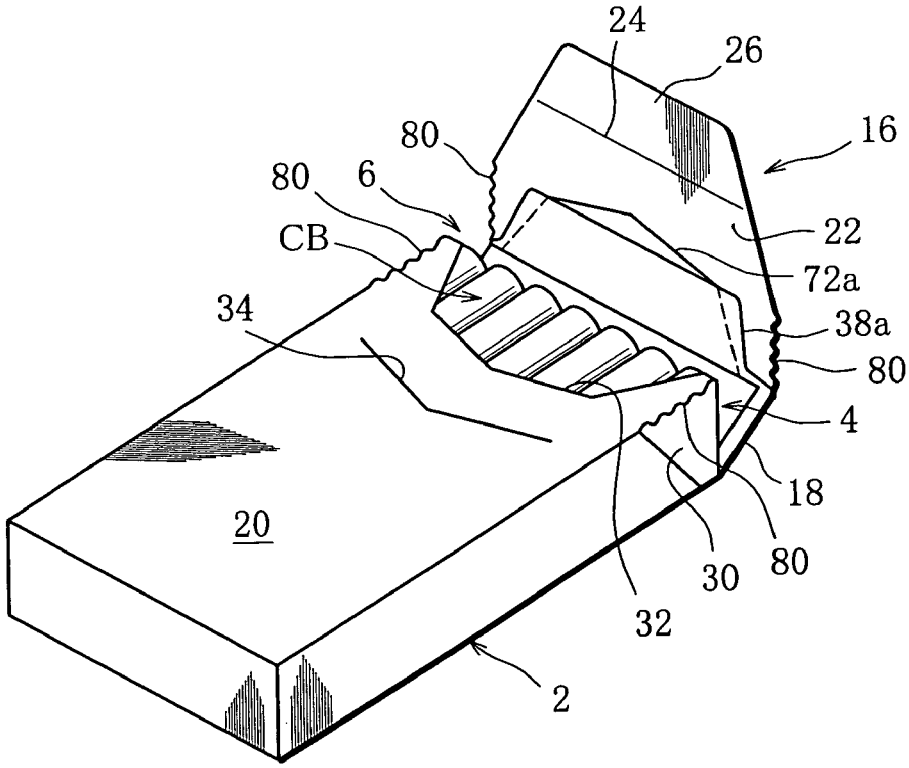
FIG. 11 is a perspective view showing the pack of FIG. 10 in its open state.

Furthermore, the pair of guard lugs 30 may be connected to the tongue 22 through fragile folding lines 78 as shown in FIG. 10, in place of the cutting lines 28. In this case, when the tongue lid 16 is opened for the first time, the tongue 22 is torn away from the guard lugs 30 along the folding lines 78 as illustrated in FIG. 11, and tearing lines 80 remain in both the tongue 22 and the guard lugs 30 as traces.

Figure 12:
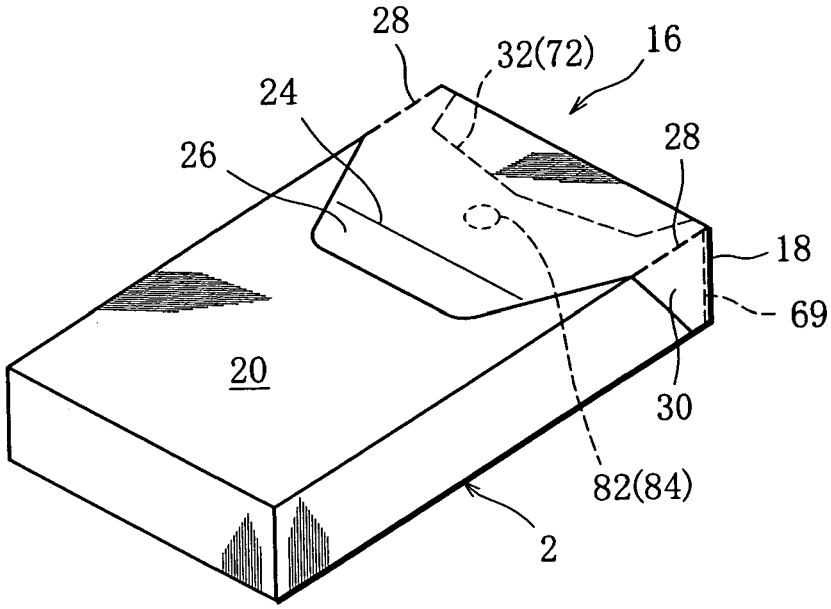
FIG. 12 is a perspective view of a tongue lid pack of a modification example.

The pack shown in FIG. 12 may have, for example, both a circular glue-applied area 82 in the back surface of the tongue 22 and a circular to-be-cutout area 84 in the front wall 20 of the box 2. The to-be-cutout area 84 is demarcated by a cutting line and located between the access opening 32 (or the to-be-opened area 72) and the insertion slit 34. When the pack is produced, the tongue 22 is in a state bonded to the to-be-cut-out area 84 through the glue-applied area 82.

Figure 13:
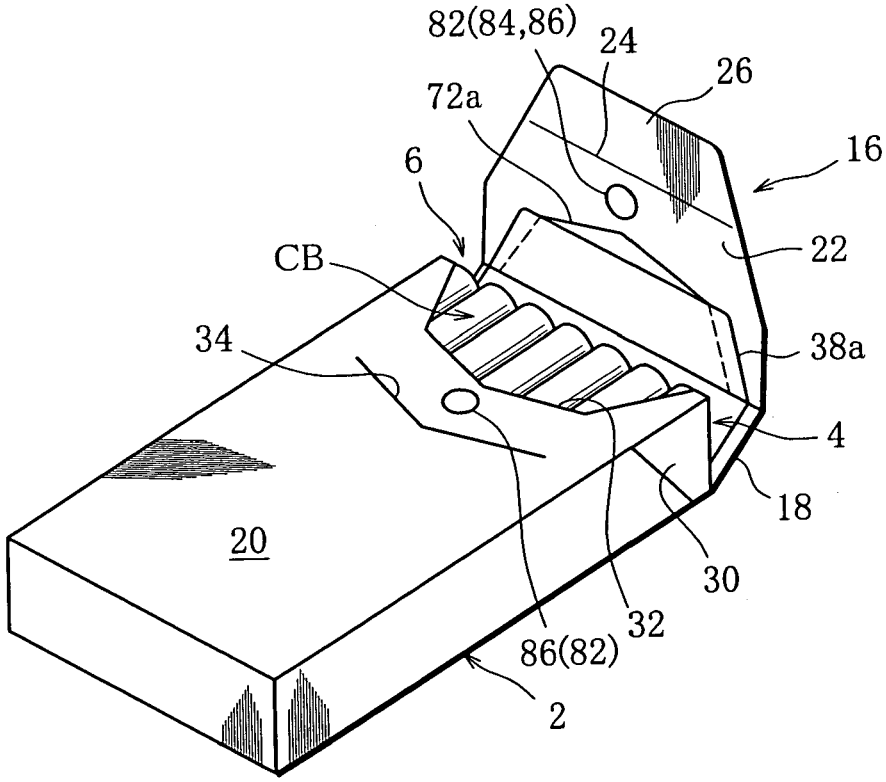
FIG. 13 is a perspective view showing the pack of FIG. 12 in its open state.

In this case, when the tongue lid 16 is opened for the first time, the glue-applied area 82 of the tongue 22 causes the to-be-cut-out area 84 to separate from the front wall 20 and forms a circular hole 86 corresponding to the area 84 in the front wall 20 as illustrated in FIG. 13. The circular hole 86 becomes a trace indicating that the tongue lid 16 has already been opened. Consequently, after the tongue lid 16 is once opened, the tongue lid 16 will never be bonded to the front wall 20 of the box 2 again, which prevents the filter cigarettes of the contents 6 from being tampered with. For this reason, in the case of the tongue lid pack shown in FIGS. 12 and 13, the pair of guard lugs 30 is necessarily required.

In the case of the pack shown in FIGS. 12 and 13, the tongue 22 may be provided with the to-be-cut-out area 84, and the front wall 20 of the box 2 with the glue-applied area 82. In this case, when the tongue lid 16 is once opened, a circular hole 86 is formed in the tongue 22, and the circular hole 86 becomes a clear trace for preventing from the tampering.

Figure 14:
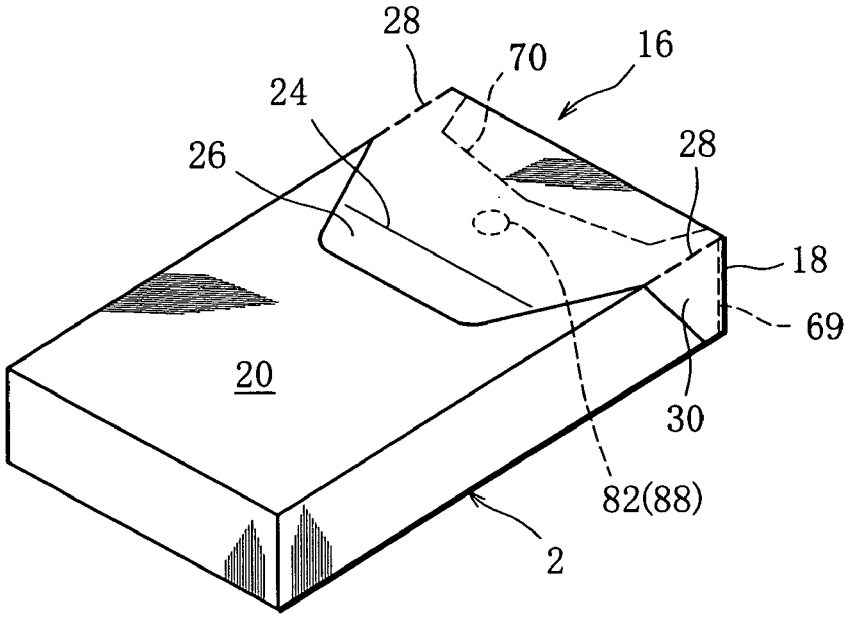
FIG. 14 is a perspective view of a tongue lid pack of a modification example.
Figure 15:
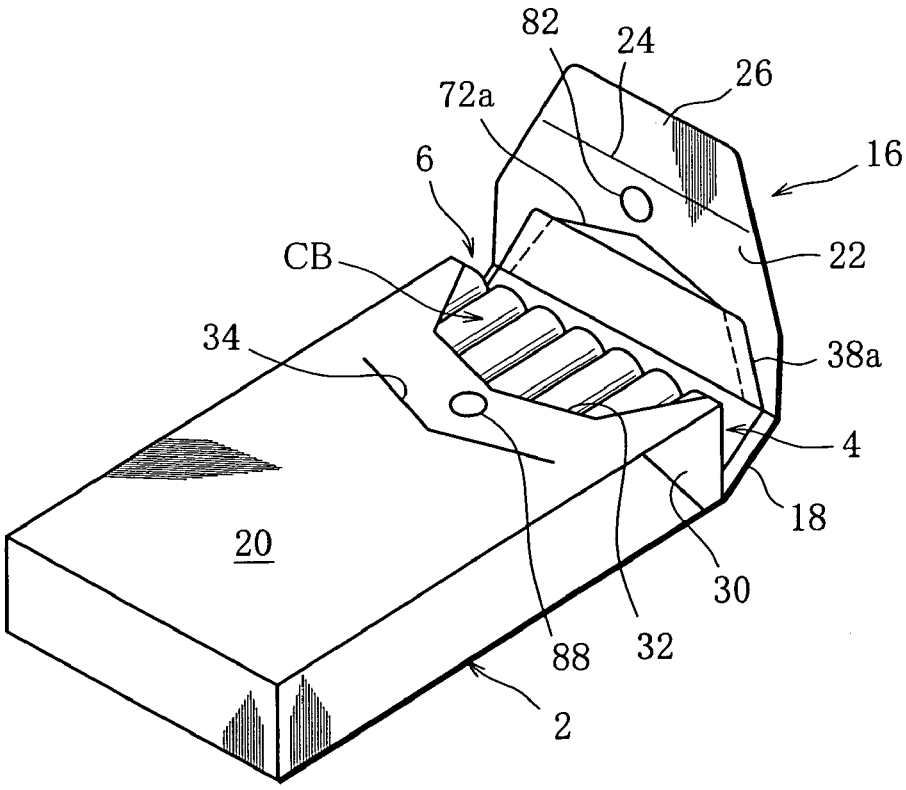
FIG. 15 is a perspective view showing the pack of FIG. 14 in its open state.

Furthermore, the to-be-cut-out area 84 may be replaced by the glue-applied area 88 similar to the glue-applied area 82 as is clear from FIGS. 14 and 15. Again, when the tongue lid 16 is once opened, the tongue lid 16 will never be bonded to the front wall 20 of the box 2, and there remains traces indicating that the glue-applied areas 82, 88 have peeled off each other in an adhering face of the areas 82, 88. This is also effective for prevention from being tampered with the filter cigarettes of the contents 6. As a consequence, the pack shown in FIGS. 14 and 15 do not necessarily require the pair of guard lugs 30.

The invention claimed is:

1. A tongue lid pack for rod-shaped smoking articles, comprising:

a box having a front wall, an opening end, two side walls, a bottom wall, and an insertion slit formed in the front wall;

contents contained in said box and including a plurality of rod-shaped smoking articles and a wrapper wrapping the rod-shaped smoking articles;

a tongue lid jointed to a rear edge of the opening end of said box for opening and closing the opening end, said tongue lid including a lid for covering the opening end of said box, and a tongue connected to the lid through a folding line and being able to be superposed upon the front wall of said box so as to cover the insertion slit; and a joint for separably connecting said tongue lid and said box to each other when said tongue lid is in a state before being opened for the first time, said joint including a pair of guard lugs bonded to respective side walls of said box, and cutting lines for separably connecting the guard lugs to corresponding side edges of the tongue so that after said tongue lid is opened, the cutting lines leave traces indicating that said tongue lid has already been opened.

2. The pack according to claim 1, wherein:

said tongue lid further includes an insertion tip located at a distal end of the tongue, the insertion tip being able to insert into said box through the insertion slit.

3. The pack according to claim 2, wherein:

the insertion slit is formed into the shape of a substantial V that splays toward the opening end side of said box.

4. The pack according to claim 2, wherein:

said joint further includes a to-be-cutout area demarcated in the tongue by a cutting line, and a glue-applied area formed in the front wall of said box, for bonding the to-be-cut-out area to the front wall when said tongue lid is in the state before being opened for the first time.

5. The pack according to claim 1, wherein:

said box includes one of an access opening formed in the front wall and extending from a front edge of the opening end toward the insertion slit, and a to-be- -opened area demarcated by a separating line to form the access opening;

the wrapper includes a separable area in a portion corresponding to the access opening, the separable area being separably demarcated by a separating line; and the pack further includes a first glue-applied area for bonding a back surface of the tongue and the separable area of the wrapper to each other through the access opening or the to-be-opened area.

6. The pack according to claim 5, wherein:

said contents include an upper closing end face located on the opening end side of said box and formed by folding the wrapper;

the upper closing end face has a pair of end flaps, an inner flap and an outer flap that forms part of the separable area, the inner and the outer flaps being superposed upon the end flaps in order; and the pack further includes a second glue-applied area for bonding the outer flap and a back surface face of the lid to each other.

7. The pack according to claim 6, wherein:

said contents include a closing side face located on one side wall side of said box and formed by folding the wrapper, the closing side face being formed by superposing both end edges of the wrapper one upon the other; and the pack further includes a third glue-applied area for bonding the closing side face and an inner surface of said box to each other.

8. The pack according to claim 6, wherein:

said contents include a lower closing end face located on the bottom wall side of said box and formed by folding the wrapper material; and the pack further includes a fourth glue-applied area for bonding the lower closing end face and the bottom wall of said box to each other.

9. The pack according to claim 1, wherein:

said joint further includes a to-be-cutout area demarcated in the front wall of said box by a cutting line, and a glue-applied area formed in said tongue lid, for bonding the to-be-cutout area to said tongue lid when said tongue lid is in the state before being opened for the first time.

10. The pack according to claim 1, wherein:

said joint further includes a pair of reinforcing members bonded to a back surface of the lid, and cutting lines for separably connecting the reinforcing members to the both side walls of said box, respectively, when said tongue lid is in the state before being opened for the first time.

11. The pack according to claim 10, wherein:

said joint further includes:

a to-be-cutout area demarcated in the front wall of said box by a cutting line; and a glue-applied area formed in said tongue lid, for bonding the to-be-cut-out area to said tongue lid when said tongue lid is in the state before being opened for the first time.

12. The pack according to claim 10, further including:

a to-be-cutout area demarcated in the tongue by a cutting line; and a glue-applied area formed in the front wall of said box, for bonding the to-be-cut-out area to the front wall when said tongue lid is in the state before being opened for the first time.

13. A blank for forming said box and tongue lid pack according to claim 1, the blank comprising:

a longitudinal axis;

a main section having a rear panel, an outer bottom panel, and a front panel which are adjacently arranged through folding lines along said longitudinal axis, the panels forming a rear wall, a bottom wall, and a front wall of the box, respectively;

a pair of inner side flaps connected to respective side edges of said rear panel through folding lines;

a pair of inner bottom flaps located on respective sides of said outer bottom panel and connected to said respective inner side flaps through folding lines, said inner bottom flaps forming reinforcing members for the bottom wall of said box;

a pair of outer side flaps connected to respective side edges of said front panel through folding lines, said outer side flaps forming side walls of said box together with said corresponding inner side flaps;

a sub-section extending from said main section along said longitudinal axis and connected to said rear panel through a folding line, said sub section having an outer top panel and a tongue panel that are demarcated by a folding line and form said lid and said tongue of said box, respectively; and a pair of lug flaps connected to respective side edges of said tongue panel through cutting lines, said lug flaps forming said guard lugs when being bonded to said corresponding outer side flaps.

14. A blank for forming said box and tongue lid pack according to claim 10, the blank comprising:

a longitudinal axis;

a main section having a rear panel, an outer bottom panel, and a front panel which are adjacently arranged through folding lines along said longitudinal axis, the panels forming a rear wall, a bottom wall, and a front wall of the box, respectively;

a pair of inner side flaps connected to respective side edges of said rear panel through folding lines:

a pair of inner bottom flaps located on respective sides of said outer bottom panel and connected to said respective inner side flaps through folding lines, said inner bottom flaps forming reinforcing members for the bottom wall of said box;

a pair of outer side flaps connected to respective side edges of said front panel through folding lines, said outer side flaps forming side walls of said box together with said corresponding inner side flaps;

a sub-section extending from said main section along said longitudinal axis and connected to said rear panel through a folding line, said sub section having an outer top panel and a tongue panel that are demarcated by a folding line and form said lid and said tongue of said box, respectively;

a pair of lug flaps connected to respective side edges of said tongue panel through cutting lines, said lug flaps forming said guard lugs when being bonded to said corresponding outer side flaps; and a pair of inner top flaps located on respective sides of said outer top panel, the inner top flaps being connected to said corresponding inner side flaps through cutting lines, wherein:

said inner top flaps are bonded to said lid of said tongue lid when said tongue lid is in the state before being opened for the first time, and form said reinforcing members.

* * * * *